US005413515A

United States Patent [19]

Knox

[11] Patent Number: 5,413,515

[45] Date of Patent: May 9, 1995

[54] TOY CRANE CONFIGURABLE INTO THREE DIFFERENT OPERATING MODES

[76] Inventor: Richard F. Knox, 212 S. 21st Pl., La Crosse, Wis. 54601

[21] Appl. No.: 176,266

[22] Filed: Jan. 3, 1994

[51] Int. Cl.[6] ..... A63H 33/30; A63H 33/04

[52] U.S. Cl. ..... 446/75; 446/85; 446/424; 446/426; 446/427

[58] Field of Search ..... 446/75, 228, 425, 426, 446/427, 85, 424

[56] References Cited

U.S. PATENT DOCUMENTS

| | | | |
|---|---|---|---|
| 10,114 | 5/1882 | Reed | 446/75 |
| 1,685,707 | 9/1928 | Keedy | 446/426 |
| 1,745,276 | 1/1930 | Sherwood | 446/427 |
| 2,071,905 | 3/1936 | Smith | 414/915 |
| 2,072,698 | 3/1937 | Andrews | 446/75 |
| 2,094,618 | 10/1937 | Pridham | 446/427 |
| 2,104,628 | 1/1938 | Warren | 446/75 |
| 2,209,359 | 7/1940 | Stevens | 446/427 |
| 2,361,159 | 10/1944 | Williams | 446/426 |
| 2,665,522 | 1/1954 | Junod | 446/75 |
| 3,091,888 | 6/1963 | Patch | 446/427 |
| 3,176,862 | 4/1965 | Walters et al. | 446/425 |
| 3,539,063 | 11/1970 | Masura | 446/425 |
| 3,660,927 | 5/1972 | De Christopher | 446/426 |
| 3,793,764 | 2/1974 | Gagnon | 446/228 |
| 3,986,293 | 10/1976 | Rieur | 446/75 |
| 3,997,061 | 12/1976 | Sano | 446/426 |

FOREIGN PATENT DOCUMENTS

| | | | |
|---|---|---|---|
| 485218 | of 1952 | Canada | 446/75 |
| 907328 | 8/1972 | Canada | 446/425 |
| 2382912 | 11/1978 | France | 446/426 |
| 1203651 | of 1965 | Germany | 446/427 |

*Primary Examiner*—Mickey Yu
*Assistant Examiner*—Jeffrey D. Carlson
*Attorney, Agent, or Firm*—M. Paul Hendrickson

[57] ABSTRACT

A material handling toy which can be used in three different modes—as a mobile crane, a highline carrier, or a highline hoist. It consists of: a base (20) (top of the toy's storage box) and a platform (21) (bottom of the toy's storage box) which are held in alignment by the bottom section of the mast (40); a rear drum (30) which controls the movement of the trolley (94) in the two highline modes and the height of the boom (72) in the crane mode; a hoist drum (35) which controls any hoisting action; a pair of blocks (62, 64) near the top of the mast, which guide the line out to the boom (crane mode) or to the trolley (94)(highline modes); a cleat plate (27) at the rear of the platform, which provides securing points for various lines; a trolley (94), suspended from the highline (92), to which can be attached a load (highline carrier mode) or the hoisting pulleys from the boom, so that an object can be lifted and moved from one point to another along the highline (highline hoist mode); an anchor block (86), located at a distance from the toy, anchors the far end of the highline and provides a pulley for the trolley line (102); a turnbuckle (88) for tightening the highline. The crane mode includes a take-apart spacer (26), which raises the platform off the base and allows the platform to pivot around the axis of the mast; and axles and wheels (24), which make the crane mobile.

16 Claims, 8 Drawing Sheets

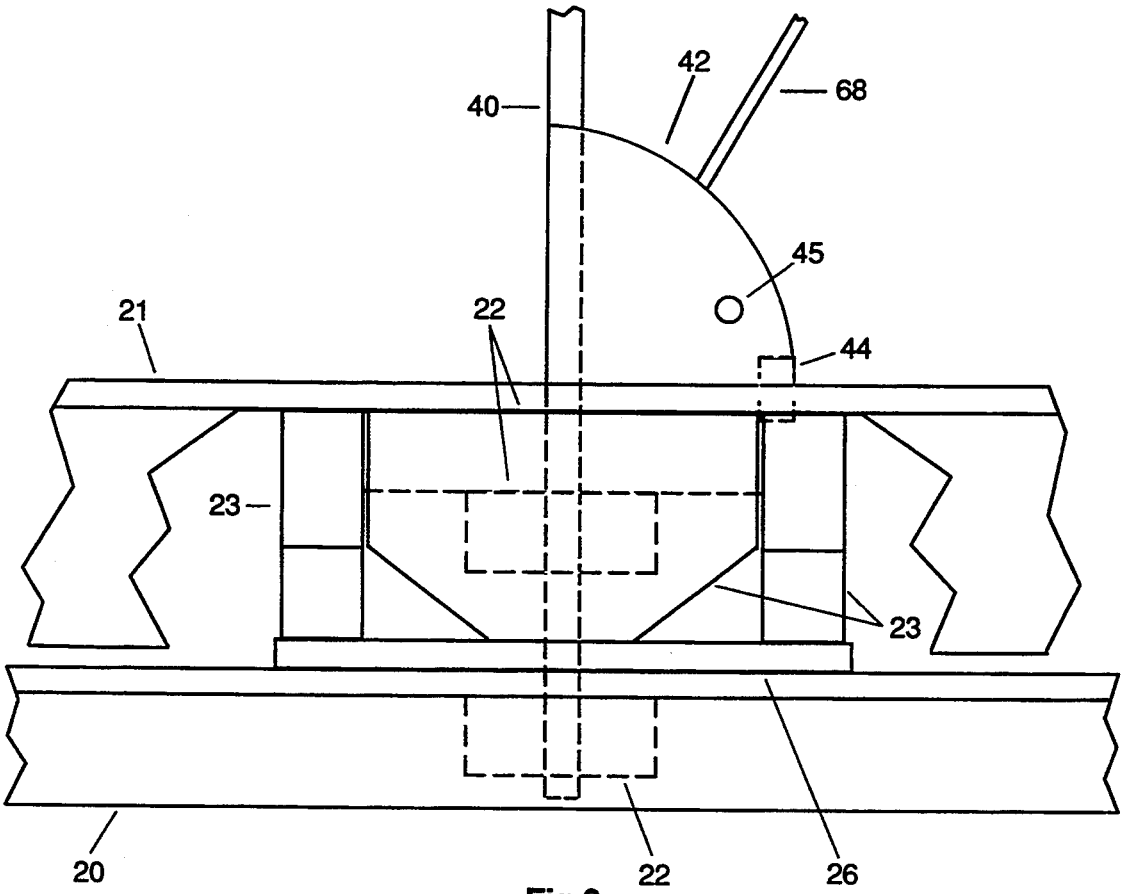
Fig 9
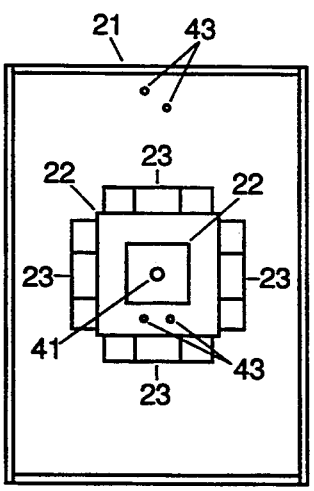
Fig 10-A
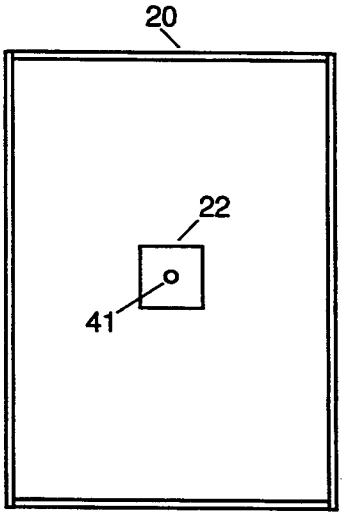
Fig 10-B

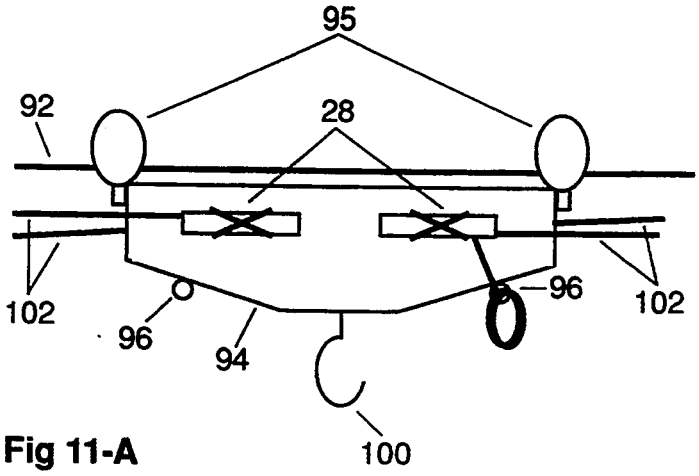
Fig 11-A
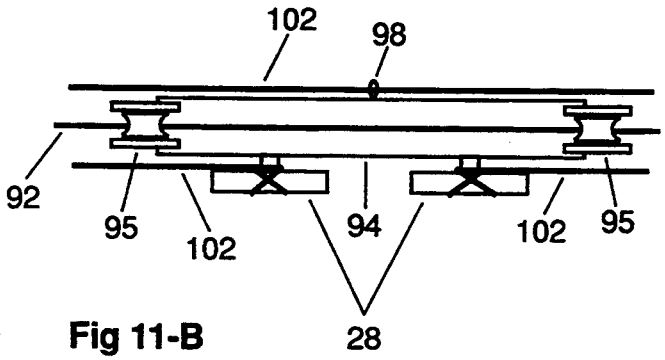
Fig 11-B
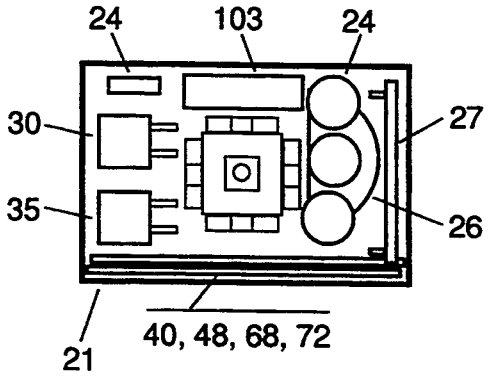
Fig 12

TOY CRANE CONFIGURABLE INTO THREE DIFFERENT OPERATING MODES

BACKGROUND—FIELD OF INVENTION

This invention incorporates three different material handling modes in one toy: a mobile crane; a trolley carrying loads along a highline; or the trolley carrying hoisting equipment along a highline. In addition, the toy's storage box becomes an integral part of the toy during its assembly and use.

BACKGROUND—DESCRIPTION OF PRIOR ART

Heretofore, toys of this type have been of a single- or double-function design. For example, a toy crane with a boom could be used only as a crane, or a crane of a "highline" type (with a trolley moving along a highline) could not be used as a boom-type crane, which could pivot around a central axis.

The "Highline Rigger" (sometimes called "Mountain Rigger") can be used in one of three different modes: to lift or move materials within a circular area around the center of its base (crane mode); or moving materials between the toy and a distant anchor point using a trolley on a highline (highline carrier mode or highline hoist mode).

Many crane-type toys have been patented over the years. Several of them have functions similar to the "Highline Rigger:"

- U.S. Pat. No. 2,209,359 to Stevens, 1939 Mar. 3, which has a comparable arrangement of mast and boom with attendant drums and blocks (pulleys), but is not mobile, self-storing, or designed for the highline modes;
- U.S. Pat. No. 2,094,618 to Pridham, 1936 Apr. 11, which allows for a carriage moving along a highline similar to the Rigger's, but which does not allow for rotation around the axis of the mast as does the Rigger in the crane mode, nor does it allow for mobility or self-storage as does the Rigger;
- U.S. Pat. No. 2,071,905 to Smith, 1936 Mar. 30, which is similar to the Rigger's crane mode, but is not designed for the highline modes;
- U.S. Pat. No. 1,745,276 to Sherwood, 1926 Mar. 6, a highline/trolley design, but it calls for an electrically powered transport (the "Highline Rigger" does not require electricity), is not self-storing, and does not function as a mobile crane.

OBJECTS AND ADVANTAGES

Accordingly several objects and advantages of my invention are as follows:

a. The toy ("Highline Rigger," or "Mountain Rigger," as this inventor calls it) can be used as a mobile crane, so that it can be moved horizontally on wheels over a level surface, and has a rotating platform which allows a raisable boom, with its attendant hoisting rigging, to be rotated around the axis of the mast in a complete circle;

b. The toy ("Rigger") can be set up as a fixed working platform, behind which one end of a highline is anchored, and the other end is anchored to a distant point, and along that tensioned highline a trolley can be moved by means of a line controlled by a drum mounted close to a mast on the platform, thereby making it possible for a load to be moved along the path of the highline, as does a cable car;

c. Once the highline has been rigged, a set of two cargo-hoisting blocks (pulleys) can be suspended from a trolley on the highline, and a load can be moved up to or down from the trolley by means of a hoist drum located on the platform, and that load also can be moved along the path of the highline, suspended from the trolley by a hoisting mechanism;

d. The entire toy can be taken apart to be stored when not in use; and e. The storage box for the parts which comprise the Rigger becomes an integral part of the assembled toy, i.e., the top of the storage box serves as the base of the toy, and the bottom of the storage box serves as the platform, to which are attached the drums, a mast and a cleat plate.

Previous inventions in this class have been capable of either the crane mode or the highline modes, but the capability of operating both in the crane and highline modes has not been possible until this new toy was invented.

Further objects and advantages of my invention will become apparent from a consideration of the drawings and ensuing description of it.

DRAWING FIGURES

FIG. 9 shows a side view of how the mast is supported by the mast support plates in the platform and base, and how the platform support posts rest on the spacer in the "mobile crane" mode.

Figure 1:
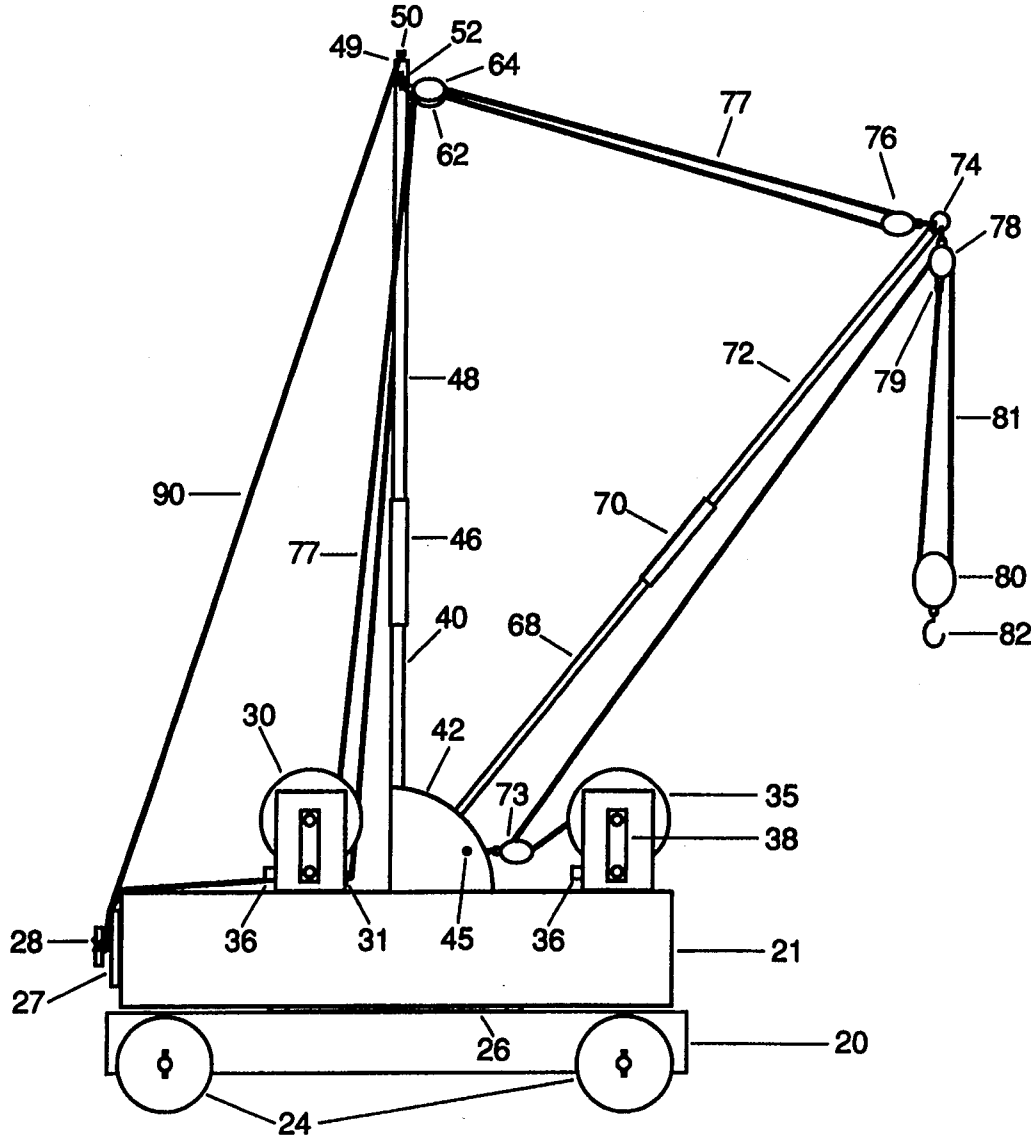
FIG. 1 shows a side view of the Rigger in the "mobile crane" mode.

FIG. 10A and FIG. 10B respectively are view from the open sides of the platform and base showing the parts which are permanently attached inside the platform and base.

FIG. 11A shows a side view and FIG. 11B shows a top view of the trolley as it is suspended from the highline.

FIG. 12 shows where the parts of the Rigger can be stored in the platform, after the Rigger has been disassembled.

| Reference Numerals |
|---|
| 20 base (top of storage box) |
| 21 platform (bottom of storage box) |
| 22 mast alignment plates (three) |
| 23 platform support posts (four) |
| 24 wheels, axles (crane mode) |
| 25 holes for 24 (axles) |

-continued

| Reference Numerals | |
|---|---|
| 26 | spacer (crane mode) |
| 27 | cleat plate (rear of platform) |
| 28 | cleats |
| 29 | cleat plate eye |
| 30 | boom/trolley drum (mounted behind mast) |
| 31 | eye (front of boom/trolley drum) |
| 35 | hoist drum (mounted at front of platform) |
| 36 | drum locking wedge (one per drum) |
| 38 | crank arms |
| 40 | mast (lower section) |
| 41 | hole for 40 |
| 42 | boom guides |
| 43 | holes for mounting cable drums |
| 44 | mast alignment pin |
| 45 | cross pin |
| 46 | coupler (mast) |
| 48 | mast (upper section) |
| 49 | mast head |
| 50 | mast head pin |
| 52 | mast head crosspiece |
| 58 | hole for 62 |
| 60 | hole for 64 |
| 62 | mast head block, left |
| 64 | mast head block, right |
| 66 | hole for 75 |
| 68 | boom (lower section) |
| 70 | coupler (boom) |
| 72 | boom (upper section) |
| 73 | boom heel block (swiveled) |
| 74 | boom eye |
| 75 | mast head hoist block |
| 76 | boom lift block |
| 77 | boom line |
| 78 | boom hoist block |
| 79 | swivel connector |
| 80 | cargo hook block |
| 81 | cargoline |
| 82 | cargo hook |
| 84 | anchor point (rear) |
| 85 | anchor point (distant) |
| 86 | anchor block |
| 88 | turnbuckle |
| 90 | mast support line |
| 92 | highline |
| 94 | trolley |
| 95 | trolley blocks |
| 96 | eyes for securing excess trolley line |
| 98 | trolley line guide eye |
| 100 | trolley hook |
| 102 | trolley line |
| 103 | parts box |

DESCRIPTION—FIGS. 1 to 12

(NOTE: Dimensions of major parts can be found at the end of this section, on page 6.)

Figure 4:
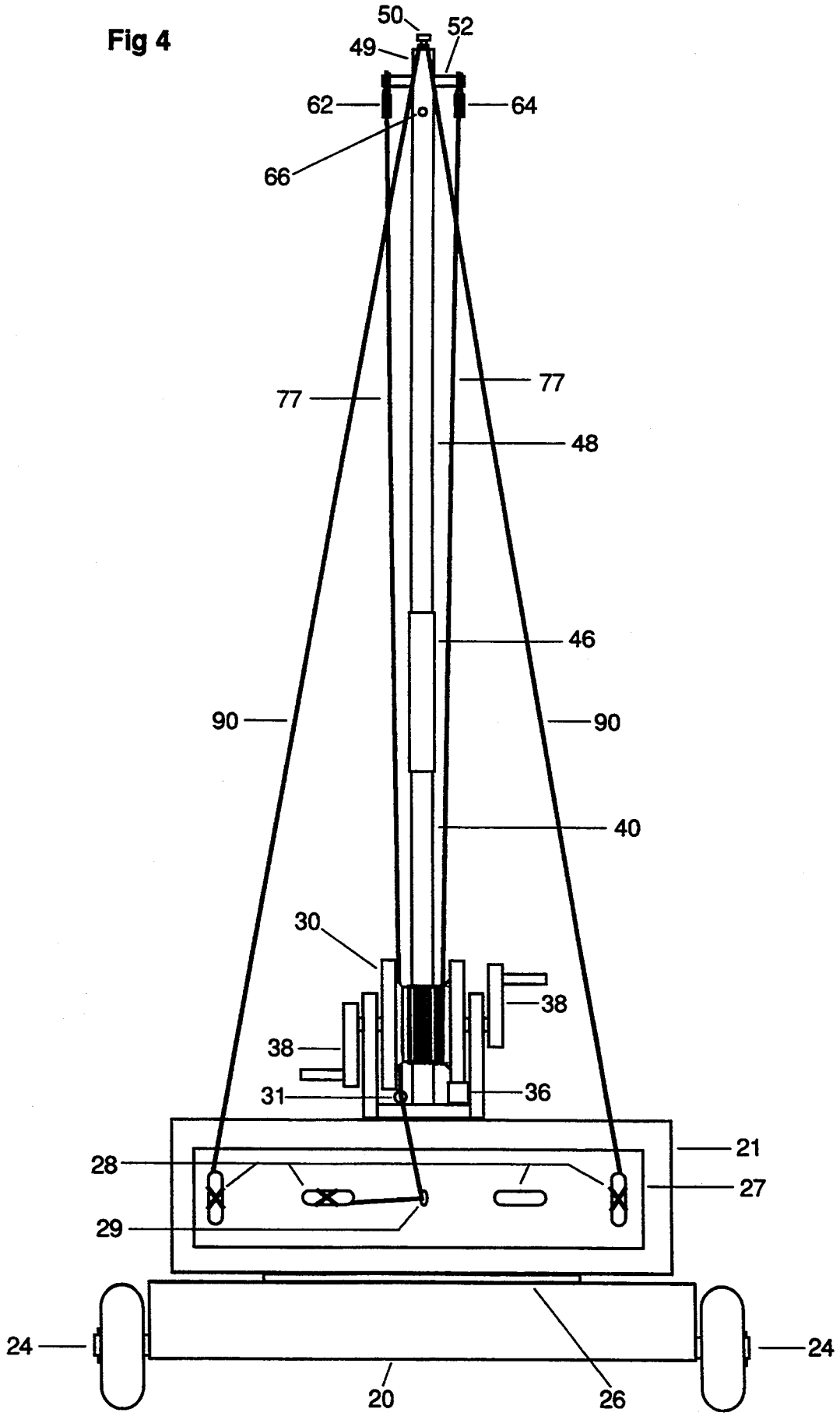
FIG. 4 shows the Rigger from the mast rearward, in the "mobile crane" mode.

FIG. 1 shows the Highline Rigger in the "mobile crane" mode. The various parts of the Rigger have been removed from the Rigger's storage box, and the top of the storage box has been positioned with the open side down; axles and wheels 24 have been attached to it to form the base 20 of the Highline Rigger. A boom/trolley drum 30 and a hoist drum 35 and cleat plate 27 have been secured to a platform 21. A two-part spacer 26 (FIG. 5) has been assembled and positioned between the base 20 and the platform 21 (the bottom of the Rigger's storage box, with the open side down). The lower section of a mast 40 has been pushed through the platform and spacer and into the center of the base 20 (FIG. 10), to hold the base 20 and the platform 21 in alignment and to allow the platform 21 to pivot a full circle around the axis of the mast. The upper section of the mast 48 has been joined to the lower mast section 40 by means of a tubular coupler 46. Mast head blocks 62 and 64 have been secured by short lines to the ends of a crosspiece 52. A boom has been assembled (68, 70, 72) and a boom lift block 76 and a boom hoist block 78 have been secured to a boom eye 74. The bottom end of the boom has been placed between two boom guides 42. Mast support lines 90 have been secured from a mast head pin 50 to outboard cleats of a cleat plate 27 (FIG. 4). A line from a boom/trolley drum 30 has been run up and over the fight mast head block 64, to and around the boom lift block 76, back to and over the left mast head block 62, down to and through 31, an eye in front of the boom/trolley drum, and back to and secured to a cleat on cleat plate 27 (FIG. 4). The load-lifting capability comes from a cargo line which runs from a hoist drum 35, to and around a boom heel block 73, up to and over the boom hoist block 78, down to and around a cargo hook block 80, and up to and secured to swivel connector 79 (the end of the cargo line could be connected directly to the cargo hook, but then more power would be required to lift a load).

Figure 2:
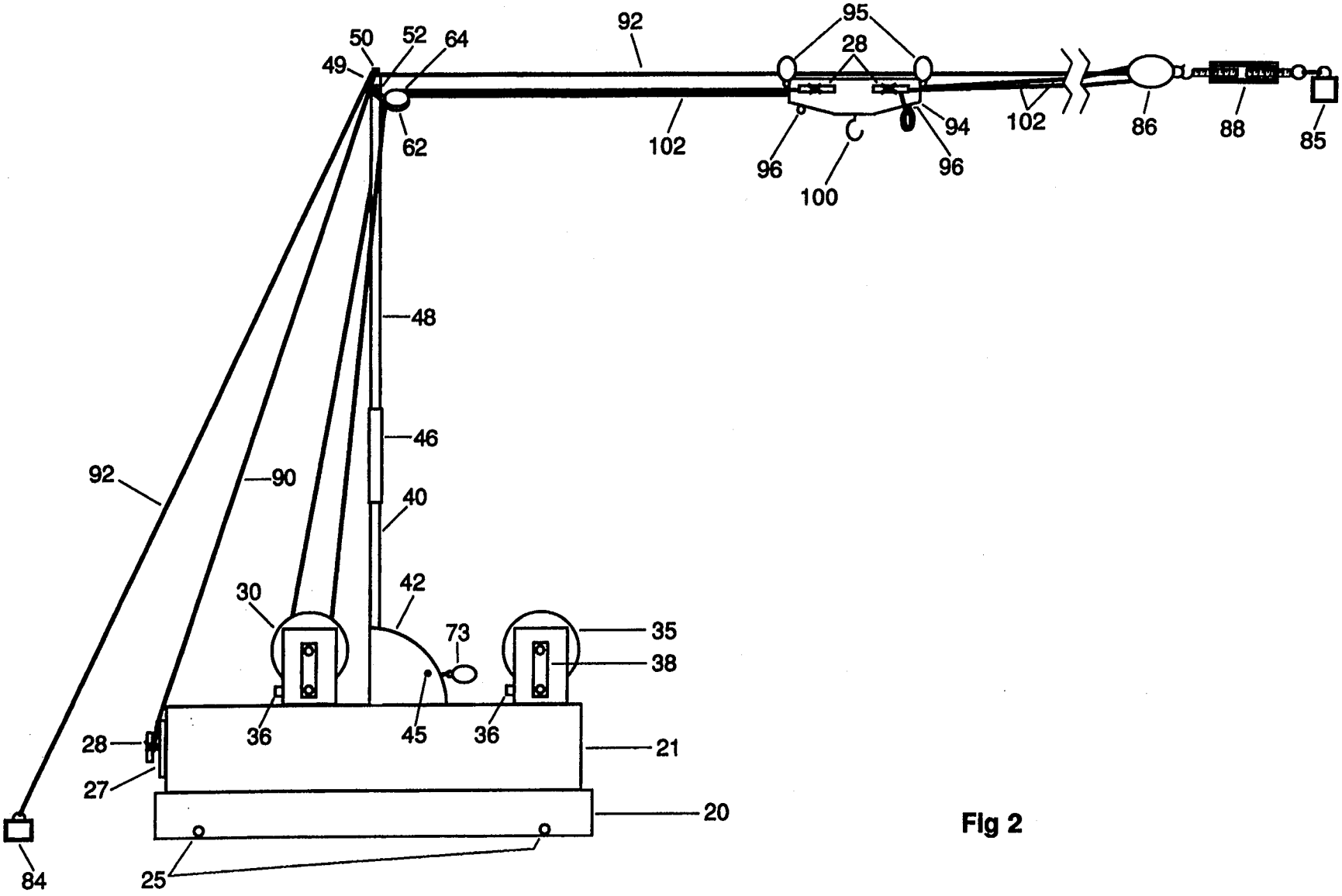
FIG. 2 shows a side view of the Rigger in the "highline carrier" mode.

FIG. 2 shows the "highline carrier" mode, which is set up by removing the boom assembly (68, 70, 72) and the wheels and axles 24 and spacer 26 from the "mobile crane" mode. A highline 92 is secured to a rear anchor point 84 just behind the Rigger, then secured to a mast head pin 50 and then to an anchor block 86, which has been secured to a distant anchor point 85 by means of a turnbuckle 88. (The distance from the Rigger to the distant anchor point 85 is variable.) A trolley 94 is suspended from the highline 92 by a pair of blocks 95; the trolley 94 is moved along the highline 92 by means of a trolley line 102. The trolley line 102 is wrapped twice around a boom/trolley drum 30 (FIG. 6), which controls the movement of trolley 94 along the highline 92, from the mast head 49 to the anchor block 86. A trolley hook 100 allows a load to be suspended from the trolley 94.

Figure 3:
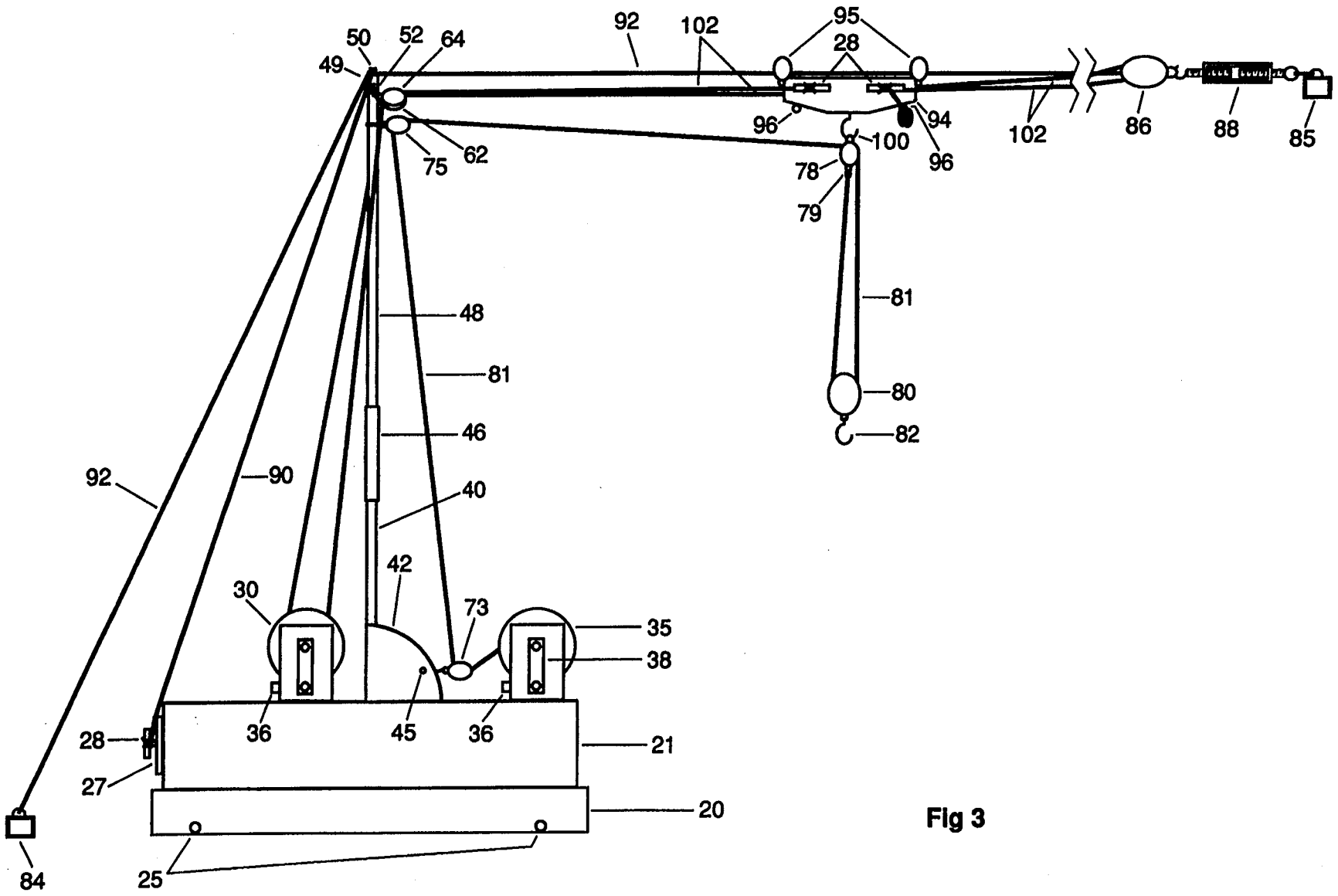
FIG. 3 shows a side view of the Rigger in the "highline hoist" mode.

FIG. 3 shows a third mode of operation, the "highline hoist" mode, which is set up by securing a mast head hoist block 75 to the mast head, and by hanging a boom hoist block 78 from a trolley hook 100. Then a cargo line 81 from a hoist drum 35 is run around a boom heel block 73, over the mast head hoist block 75, and out to a hoist block 78 on trolley hook 100. A cargo hook block 80 and cargo hook 82 are rigged in the same manner as in the "mobile crane" mode (FIG. 1).

FIG. 4 shows a rear view of the Rigger in the "crane mode" (see FIG. 1), from the mast rearward. One end of a boom line 77 is secured to a boom/trolley drum 30; the other end has been run out to a boom eye 74 (FIG. 1), brought back, and secured to a cleat 28 on a cleat plate 27. Mast support lines 90 run from a mast head pin 50 and are secured to outboard cleats on a cleat plate 27.

Figure 5:
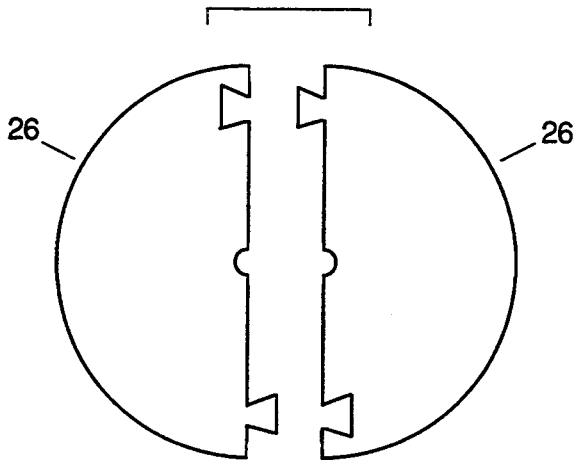
FIG. 5 shows a top view of the spacer for the "mobile crane" mode, before the two separated parts have been assembled.

FIG. 5 shows the two parts of a take-apart spacer 26, before the spacer has been assembled. When the spacer 26 is assembled, there is a hole in its center to allow the end of the lower mast section 40 to pass through a spacer 26.

Figure 6:
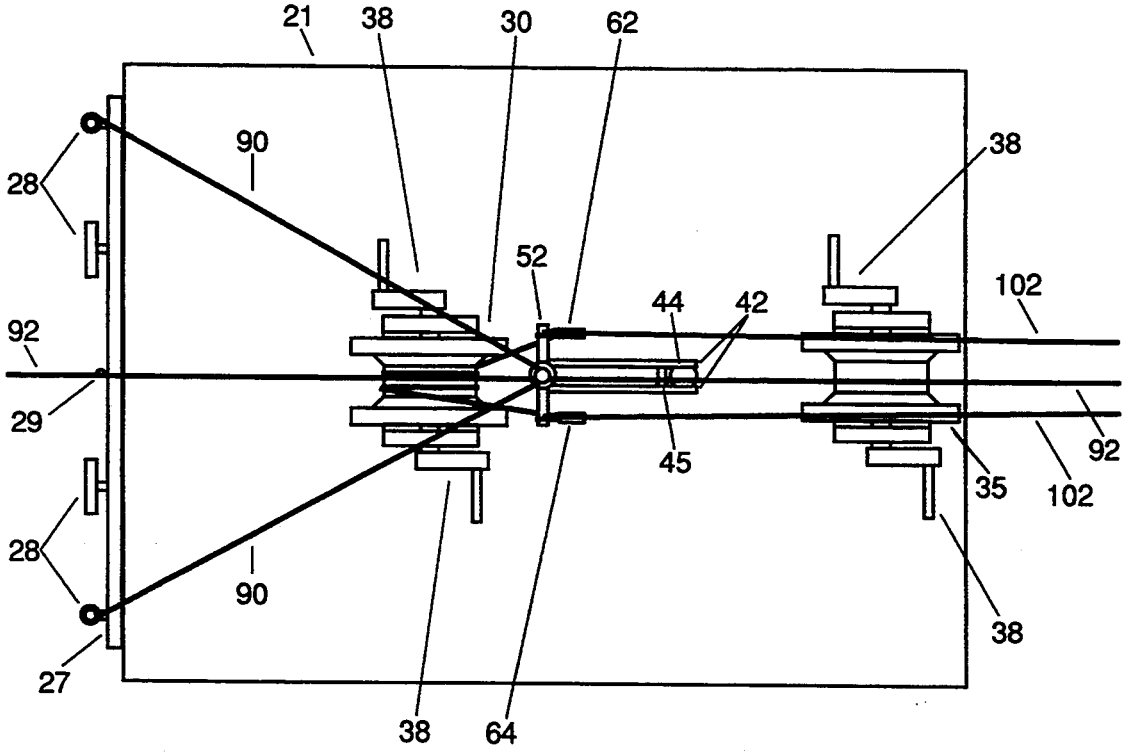
FIG. 6 shows a top view of the platform, with mast and drums, rigged for the "highline carrier" mode.

FIG. 6 shows a top view of the Rigger in the "highline carrier" mode. (The base 20, located beneath the platform 21, is not shown.) A trolley line 102 has been wound twice around a boom/trolley drum 30. A hoist drum 35 is shown without any cargo line on it. (Not shown in FIG. 6 is a rear anchor point 84, which would be off to the left of the Rigger platform. Also not shown, off to the right, would be a trolley 94, a distant anchor point 85, turnbuckle 88, and anchor block 86.) Crank arms 38 for the drums are shown (two crank arms per drum, for rotating the drums from either side of the platform 21.)

Figure 7:
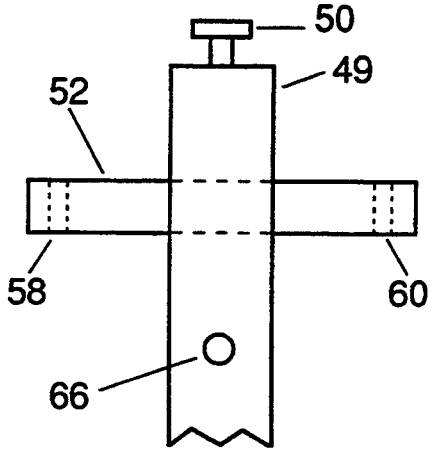
FIG. 7 shows a rear view of the mast head crosspiece, to which are attached the mast head blocks.

FIG. 7 shows a mast head crosspiece 52 attached to the mast through a hole drilled at a right angle to the mast near the mast head 49. Left and right mast head blocks (62 and 64) would be secured to the mast head crosspiece 52 by means of short pieces of line attached to the blocks and run through holes 58 and 60 in the ends of the mast head crosspiece 52.

Figure 8:
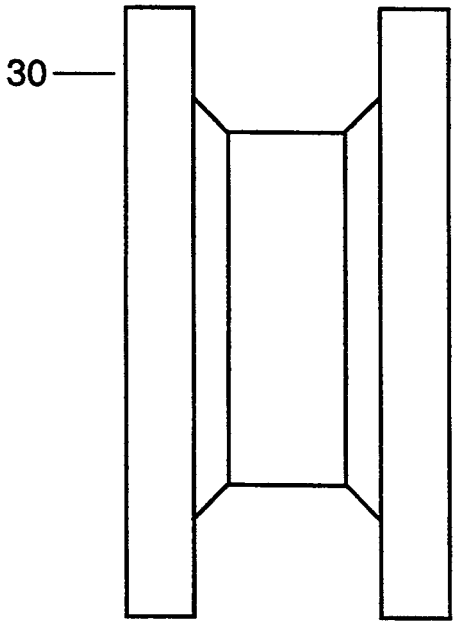
FIG. 8 shows a rear view of the core of the boom/-trolley drum and how it flares out where it meets the side flanges, to prevent fouling of the trolley line.

FIG. 8 shows how the core of the boom/trolley drum flares out where it meets the side flanges of the drum. This inclined, angled surface prevents the trolley line 102 from fouling itself as the drum is rotated to move a trolley along the highline 92. Without the flare, a line would tend to overlap itself for about an inch or more, causing a resistance to the smooth movement of the trolley line around the core of the boom/trolley drum 30.

FIG. 9 shows a lower mast section 40 pushed through the three mast alignment plates 22 in the platform 21 and base 20, to provide vertical support for the lower end of the mast. The plates 22 also keep the platform 21 centered over the base 20. A spacer 26 is positioned between the upper surface of the base 20 and lower surfaces of four platform support posts 23, to provide a bearing surface on which the platform 21 can rest and on which it can rotate around the center of the base 20 in the crane mode (FIGS. 1 and 4). A mast alignment pin 44, which is fixed between two boom guides 42, keeps the mast and boom guides locked into a fixed position relative to the top surface of the platform 21. The boom guides 42 provide a slot into which the lower end of the boom 68 nestles, allowing the boom to pivot vertically at the point where the bottom end of the boom rests against the mast. Also, the boom guides 42 prevent the boom from moving laterally. A cross pin 45 is a securing point for a boom heel block 73.

FIG. 10 shows the platform 21 and base 20 from their open sides. Four platform support posts 23 rest on and slide over the upper surface of a spacer 26 in the crane mode. For all of the three Rigger modes, three mast alignment plates 22 hold the lower section of the mast 40 in a vertical position in holes 41 through their centers. Holes 43 for mounting drums 30 and 35 are shown.

FIG. 11 shows a side view (left) and a top view (right) of the trolley 94, as it would be suspended from a highline 92 by its two trolley blocks 95. A trolley line guide eye 98 (top view) helps keep the trolley line 102 alongside the trolley 94 as it moves along a highline 92. Two cleats 28 on the trolley are for securing the two ends of the trolley line 102 to the trolley 94. The excess trolley line is rolled up and is secured to whichever eye 96 is closer.

FIG. 12 shows where the parts of the Rigger can be stored after disassembly of the Rigger. The platform 21 is positioned with its open side up, so it can serve as the bottom of a storage box.

| | Dimensions | Thickness | Width | Length |
|---|---|---|---|---|
| 20 | base (top of storage box) | 3.2 cm | 22.8 cm | 30.4 cm |
| 21 | platform (bottom of storage box) | 6.3 cm | 20.9 cm | 28.8 cm |
| 22 | mast alignment plate (one large) | 1.9 cm | 8.6 cm | 8.6 cm |
| | mast alignment plate (two small) | 1.9 cm | 4.4 cm | 4.4 cm |
| 23 | platform support post (four) | 1.9 cm | 5.4 cm | 7.9 cm |
| 24 | wheel (crane mode) | 1.7 cm | 5.0 cm (dia) | |
| 26 | spacer (crane mode) | 0.6 cm | 13.3 cm (dia) | |
| 27 | cleat plate | 0.6 cm | 4.1 cm | 18.9 cm |
| 30 | hoist drum (core) | 3.2 cm (dia) | | 1.7 cm |
| | hoist drum (flanges) | 0.6 cm | 5.4 cm (dia) | |
| 40 | mast (above surface of 21) | 0.9 cm (dia) | | 17.8 cm |
| | mast (below surface of 21) | 0.9 cm (dia) | | 9.4 cm |
| 42 | boom guides | 0.6 cm | 5.9 cm (radius) | |
| 44 | mast alignment pin | 0.9 cm (dia) | | 1.4 cm |
| 46 | coupler (mast) | 0.9 cm (in dia) | | 6.7 cm |
| 48 | mast (upper section) | 0.9 cm (dia) | | 26.6 cm |
| 52 | mast head crosspiece | 0.45 cm (dia) | | 3.5 cm |
| 68 | boom (lower section) | 0.6 cm (dia) | | 27.3 cm |
| 70 | coupler (boom) | 0.6 cm (in dia) | | 5.7 cm |
| 73 | boom (upper section) | 0.6 cm (dia) | | 27.3 cm |
| 94 | trolley | 0.9 cm | 2.7 cm | 9.0 cm |

Operation of the "Highline Rigger"

BASIC ASSEMBLY (start with the crane mode, FIG. 1, to get familiar with the Rigger's operation.)

1. Mount the wheels 24 to the base 20 of the Rigger, using the axles and tapered axle pins (FIG. 1).

2. Mount the cleat plate 27 to the rear of the platform 21. (Use washers and wingnuts provided to secure cleat plate and drums.)

3. Mount the boom/trolley drum 30 and the hoist drum 35 to the platform 21, such that the drum locking wedges 36 are pointed to the rear of the Rigger (toward the cleat plate 27).

4. With 7-inch lengths of line, secure the boom lift block 76 and the boom hoist block 78 to the boom eye 74.

5. With a 7-inch length of line, secure the boom heel block 73 (the only swiveled block) to the cross pin 45 between the boom guides 42.

6. For the crane mode, assemble the spacer 26 and position it over the hole in the center of the base (open side of base facing down).

7. Push the lower section of the mast 40 into the hole in the center of the platform 21, until the mast alignment pin 44 goes all the way into its hole. Then push the lower end of the mast 40 into the center hole of the base 20 (after first going through the spacer's 26 hole if setting up for the crane mode).

8. Using the tubular mast coupler 46, attach the upper section of the mast 48 to the lower section of the mast 40.

9. With 7-inch lengths of line, secure the left and right mast head blocks (62 and 64) to the mast head crosspiece 52, using holes 58 and 60 in the ends of crosspiece 52 as securing points.

10. Twist the upper section of the mast 48 until the crosspiece 52 is parallel to the core of drum 30.

11. Rig the mast support lines 90. Cut a 60-inch length of line. Secure the middle of the line to the mast head pin 50, using a clove hitch. Then, applying moderate tension, secure the ends of the line 90 to the outboard cleats 28 on the cleat plate 27.

12. Secure one end of a 9-foot length of line to the core of the boom/trolley drum 30; then turn the drum clockwise (as you are looking at the fight side of the Rigger) until the line is wrapped around the drum.

13. Fill the hoist drum 35 with line (when you are on the fight side of the Rigger, the hoist drum 35 should be turning clockwise as you load the line into it).

14. Connect the lower section of the boom 68 to the upper section of the boom 72 by means of the tubular boom coupler 70.

15. Insert the bottom end of the boom into the slot between the boom guides 42, such that the bottom (heel) of the boom rests in the corner formed by the lower section of the mast 40 and the top surface of the platform 21.

16. Run the free end of the line on the boom/trolley drum 30:

from the boom/trolley drum 30, up and over the fight mast head block 64;
to and around the boom lift block 76;
back to and over the left mast head block 62;
(see FIG. 4) down to and through the "eye" 31 in the frame of the boom/trolley drum 30;
back to the rear of the platform 21;
secure the end of the line to the cleat directly behind the eye 31.

17. Run the line from the hoist drum 35:

around the boom heel block 73;
up to and over the boom hoist block 78;
down to and around the cargo hook block 80;
back up and secure to the swivel connector 79 at the bottom of the boom hoist block 78.
NOTE: the swivel allows for removal of twist in cargo line 81.

18. Adjust line tensions. Check that all lines are running freely.

19. Lift a test load with the cargo hook 82. NOTE: heavy loads should be counterbalanced by a slight downward pressure on the rear (cleat plate 27) end of the platform 21.

Rigging For The Highline Modes (see FIGS. 2 and 3)

H-1. Remove the spacer 26 and wheels and axles 24 if the Rigger was last used in the crane mode.

H-2. Remove the line from the boom/trolley drum 30.

H-3. For either of the two highline modes, you need two anchor points one at least a foot or so behind the Rigger (rear anchor point 84), and the other some distance away (distant anchor point 85). Both anchor points must be solid enough to withstand the tension on the highline 92.

NOTE: C-clamps can be used for anchor points, BUT be certain that you protect the surfaces of furniture or shelves from clamp marks by using small blocks of wood as clamping pads (two per clamp). If using a sturdy table leg or c hair leg for an anchor point, wrap some cloth around it to prevent marring of the wood. Also, a newspaper or cloth should be placed under the base 20 of the Rigger, to prevent scratching the surface on which it is resting.

H-4. Secure the mast head hoist block 75 through the hole 66 in the mast head 49, just below the mast head crosspiece 52 (see FIG. 4).

H-5. Position the Rigger so that the mast head 49 is aligned with the two anchor points 84 and 85.

H-6. The turnbuckle 88 adjusts tension on the highline 92. Start with the turnbuckle bolts far apart; turning the frame will bring them together, tightening the highline 92. CAUTION: DO NOT overtighten the highline 92, or damage might occur.

H-7. Secure the closed eye of the turnbuckle 88 to the distant anchor point 85. (One possibility: if anchoring to a C-clamp, cut a piece of line long enough to go twice around the clamp and through the closed eye of the turnbuckle, then join the ends of the line with a square knot.)

H-8. Secure one end of the highline 92 to the anchor point 84 behind the Rigger. Then secure the line to the mast head pin 50 using a clove hitch.

H-9. Thread the highline 92 under the pulleys 95 of the trolley 94, such that the underslung trolley hook 100 is pointed uphill to whichever is higher, the mast head 49 or the distant anchor point 85 (to prevent a load from slipping off the trolley hook 100).

H-10. Slip the eye of the large anchor block 86 onto the open eye of the turnbuckle 88. Run the free end of the highline 92 twice around the anchor block 86 crosspiece. Tighten the highline 92, then secure it in place with two half hitches.

H-11. Check that the mast head 49 is aligned with the anchor points 84 and 85. Rotate the frame of turnbuckle 88 to bring its two bolts together, but DO NOT OVERTIGHTEN!

H-12. Determine the length needed for trolley line 102 (formula: twice the distance from mast head 49 to anchor block 86, plus 4 feet).

H-13. Wrap one end of the trolley line 102 twice around the core of the boom/trolley dram 30, such that the wrapped end of the line is on the same side of the drum as the cleats 28 are on the trolley 94.

H-14. Assuming that the loose end of the trolley line 102 (from H-13, above) is on the fight side of the Rigger, as are the cleats 28 on the trolley 94, run the trolley line 102:

from the boom/trolley drum 30 up to and over the right mast head block 64;
to the trolley 94, where the end of the trolley line 102 is secured to whichever cleat 28 on the trolley 94 is nearer the mast head 49;
run the other end of the trolley line 102 up to and over the left mast head block 62;
out to and through the trolley line guide eye 98;
to and around the anchor block 86;
back to the trolley 94, and secure to the cleat 28 on the trolley 94 which is closer to the anchor block 86 (NOTE: there should be a slight amount of tension on the trolley line 102, but not an excessive amount of tension);
wrap up any excess trolley line 102 and secure it with a wire twist tie to whichever eye 96 is closer to the anchor block 86.

H-15. Check that the mast is in a fairly upright position.

H-16. Secure the platform 21 to the rear anchor point 84 (secure a line to the anchor point 84; run the loose end of the line to and through the cleat plate eye 29, and tie it off to a cleat 28 on the cleat plate 27). You now are in the "Highline Carder" mode.

H-17. To rig for the "Highline Hoist" mode, hang the boom hoist block 78 from the trolley hook 100.

H-18. Run the cargo line from the hoist drum 35:

under and around the boom heel block 73;
up to and over the mast head hoist block 75;
out to and over the hoist block 78 on the trolley hook 100;
down to and around the cargo hook block 80;
back up and secure to the swivel connector 79 at the bottom of the hoist block 78.

H-19. As the trolley 94 is moved along the highline 102, the length of cargo line 81 must be adjusted.

Summary, Ramifications, and Scope

Thus the reader will see that the toy of the invention provides three different modes of operation (mobile crane, highline carrier, and highline hoist), and when it is finished being played with, it can be taken apart and stored in itself (the base and the platform serve as the storage box for the toy). In addition to being a fun toy to play with, it can be used in conjunction with other toys in a variety of play situations; it also helps demonstrate some of the basics of knot tying, rigging, and simple mechanics.

While my above description contains many specificities, these should not be construed as limitations on the scope of the invention, but rather as an exemplification thereof. Many other variations are possible. For example: an extension can be added to the boom, to give greater "reach" in the crane mode; the drums could be made larger, to hold more line; a different method of locking the drums could be used; or any number of accessories, such as a clamshell or an electromagnet, could be used with the toy, in its various modes of operation. Accordingly, the scope of the invention should be determined not by the embodiments illustrated, but by the appended claims and their legal equivalents.

I claim:

1. A material handling toy configurable by disassembly and reassembly of component parts of the toy into alternative modes for handling loaded materials including a crane mode for hoisting the materials about a central axis, a highline carrier mode for suspending and moving the loaded materials along a highline, and a highline hoist mode for hoisting and moving the materials along the highline, said toy comprising:

a) a supportive base equipped with detachable mobile means for transporting the toy over a surface when the toy is configured in the crane mode;
b) a detachable boom carried by said supportive base with the boom serving to support the loaded materials when said toy is configured to the crane mode;
c) pivotal means for axially pivoting said boom about a central axis;
d) boom elevating means for raising and lowering said boom;
e) material engaging means for retainingly engaging the loaded materials handled by said toy;
f) hoisting means for hoisting materials engaged by said material engaging means when said toy is configured in said crane mode and said highline hoist mode;
g) an upwardly extending mast for mooring said boom elevating means and said hoisting means to said mast when said toy is configured to the crane mode and said highline hoist mode, with said mast further serving for mooring said highline to said mast when said toy is configured in said highline carrier mode and said highline hoist mode; and
h) a trolley for moving the loaded materials along the highline when said toy is configured to the highline carrier mode and the highline hoist mode,

2. The toy according to claim 1 wherein said pivotal means comprises a rotatable platform carried by said base,

3. The toy according to claim 1 wherein the toy includes a block and tackle combination for moving the trolley along said highline when said toy is configured in said highline carrier mode and said highline hoist mode,

4. The toy according to claim 2, wherein the boom elevating means comprises a block and tackle combination adapted for assembly to said mast and said boom when said toy is configured to the crane mode,

5. The toy according to claim 2 wherein the toy includes a pair of boom guides for lateral assembly upon the platform along a vertical pathway formed by said boom by raising and lowering said boom,

6. The toy according to claim 1 wherein the hoisting means comprises a hoisting block and tackle combination for securance to:

(a) an upper portion of the boom for hoisting materials when the toy is configured to the crane mode, and
(b) the trolley for hoisting materials when said toy is configured to the highline hoist mode,

7. The toy according to claim 2 wherein the platform includes a mast mount for mounting the mast to the supportive base and an axial platform support assembly for assembly onto a lower section of the mast so as to axially support the platform thereby and permit said lower section to serve as the pivotal means for axially rotating said platform about the central axis.

8. The toy according to claim 2 wherein the toy includes for assembly a pair of laterally positionable guides which upon assembly to the platform straddles the boom and serves to guide the boom when raising and lowering the boom by said boom elevating means.

9. The toy according to claim 1 wherein the mast includes a cross piece for attachment onto an upper section of the mast, with said cross piece being equipped to operationally secure:

a) the boom elevating means to the cross piece when said toy is configured to said crane mode, and
b) rigging for a trolley line when said toy is configured in said highline carrier mode and said highline hoist mode.

10. The toy according to claim 1 wherein the mast comprises multiple mast sections and at least one tubular coupler for joining the mast sections together.

11. The toy according to claim 1 wherein an upper end of the boom includes anchoring means for anchoring the boom elevating means and the hoisting means to the boom.

12. The toy according to claim 11 wherein the toy includes a boom hoist block adapted for assembly to said anchoring means and a cargo hook block equipped with a cargo hook for attachment onto the loaded materials.

13. The toy according to claim 2 wherein the hoisting means includes for assembly onto the platform a hoist drum for use in winding and unwinding a hoisting line about the hoist drum when the toy is configured in the highline hoist mode and the crane mode.

14. The toy according to claim 13 wherein the toy includes for rigging the hoisting line thereto, a pair of boom guides for assembly onto the platform so as to provide a channeled pathway for guiding the boom when said boom is raised and lowered by said elevating means, and a swiveled boom heel block adapted for mounting to the boom guides.

15. The toy according to claim 13 wherein the toy includes a mountable rear drum having flared core ends so as to permit a trolley line operatively rigged to the trolley and the rear drum core to be smoothly wound about said rear drum when said toy is configured to the highline carrier mode and the highline hoist mode and to permit uniform winding and uniform unwinding of a boom elevating line when said toy is configured to the crane mode.

16. The toy according to claim 1 wherein the platform comprises a housing for stowing unassembled component parts of the toy.

* * * * *